United States Patent [19]

Shelton

[11] 3,970,185

[45] July 20, 1976

[54] SYLLABIC TYPEWRITER

[75] Inventor: Dothan L. Shelton, Amarillo, Tex.

[73] Assignee: Syllographic Machines, Inc.

[22] Filed: Dec. 30, 1971

[21] Appl. No.: 213,863

[52] U.S. Cl. ..... 197/9; 197/11
[51] Int. Cl.[2] ..... B41J 3/26; B41J 3/10
[58] Field of Search ..... 197/9, 11, 100

[56] References Cited

UNITED STATES PATENTS

| | | | |
|---|---|---|---|
| 1,294,611 | 2/1919 | Bryan | 197/100 |
| 1,913,831 | 6/1933 | Clark | 197/11 |
| 1,932,914 | 10/1933 | Shelton et al. | 197/11 X |
| 2,189,023 | 2/1940 | Ayres | 197/100 X |
| 3,225,883 | 12/1965 | Ayres | 197/11 |

*Primary Examiner*—E.H. Eickholt
*Attorney, Agent, or Firm*—Wendell Coffee

[57] ABSTRACT

A syllabic typewriter keyboard is provided to produce typed copy with conventional spelling, said keyboard particularly characterized by all the control keys located at the ends of the keyboard, except the upper case shift keys located elsewhere.

16 Claims, 5 Drawing Figures

FIG. 1

INVENTOR.
DOTHAN L. SHELTON
BY
ATTORNEY

INITIAL LETTERS

| KEYS | LETTERS | KEYS | LETTERS | KEYS | LETTERS | KEYS | LETTERS | KEYS | LETTERS |
|---|---|---|---|---|---|---|---|---|---|
| A | A | CHR | CHR | SCTNR | GL | ASCT | AG | ASTNR | ASQ |
| S | S | CNR | CL | SCWHN | SPY | ASCW | ASP | ASWHN | — |
| C | C | TWH | K | SCWHR | — | ASCH | — | ASWHR | — |
| T | T | TWN | J | SCWNR | SPL | ASCN | ASS | ASWNR | — |
| W | W | TWR | — | SCHNR | — | ASCR | ASCR | ASHNR | — |
| H | H | THN | TY | STWHN | XY | ASTW | AX | ACTWH | AB |
| N | N | THR | THR | STWHR | — | ASTH | ASTH | ACTWN | ADM |
| R | R | TNR | Q | STWNR | SERV | ASTN | — | ACTWR | ADDR |
| SC | SC | WHN | MY | STHNR | STRY | ASTR | — | ACTHN | AFF |
| ST | ST | WHR | — | SWHNR | — | ASWH | — | ACTHR | AFR |
| SW | SW | WNR | MR | CTWHN | BY | ASWN | ASM | ACTNR | ACQ |
| SH | SH | HNR | LY | CTWHR | BR | ASWR | — | ACWHN | — |
| SN | SN | SCTW | GW | CTWNR | — | ASHN | ASY | ACWHR | APHR |
| SR | SER | SCTH | GH | CTHNR | FL | ASHR | — | ACWNR | APL |
| CT | D | SCTN | GN | CWHNR | PHL | ASNR | ASL | ACHNR | ACCL |
| CW | P | SCTR | GR | TWHNR | KL | ACTW | ADD | ATWHN | ACKN |
| CH | CH | SCWH | SPH | SCTWHN | — | ACTH | AF | ATWHR | — |
| CN | Z | SCWN | — | SCTWHR | — | ACTN | ADV | ATWNR | — |
| CR | CR | SCWR | SPR | SCTWNR | — | ACTR | ADR | ATHNR | ATHL |
| TW | TW | SCHN | — | SCTHNR | — | ACWH | APH | AWHNR | — |
| TH | TH | SCHR | — | SCWHNR | — | ACWN | AMM | ASCTWH | ABB |
| TN | V | SCNR | — | STWHNR | — | ACWR | APR | ASCTWN | ADJ |
| TR | TR | STWH | SK | CTWHNR | BL | ACHN | ACC | ASCTWR | AGGR |
| WH | WH | STWN | — | SCTWHNR | — | ACHR | ACCR | ASCTHN | AFT |
| WN | M | STWR | XR | AS | AS | ACNR | — | ASCTHR | AFFR |
| WR | WR | STHN | STY | AC | AC | ATWH | AK | ASCTNR | AGL |
| HN | Y | STHR | — | AT | AT | ATWN | AJ | ASCWHN | ASPHY |
| HR | RH | STNR | SQ | AW | AW | ATWR | ATTR | ASCWHR | — |
| NR | L | SWHN | — | AH | AH | ATHN | — | ASCWNR | APPL |
| SCT | G | SWHR | — | AN | AN | ATHR | — | ASCHNR | — |
| SCW | SP | SWNR | — | AR | AR | ATNR | AQ | ASTWHN | — |
| SCH | SCH | SHNR | SLY | ASC | ASC | AWHN | — | ASTWHR | — |
| SCN | SS | CTWH | B | AST | AST | AWHR | — | ASTWNR | — |
| SCR | SCR | CTWN | DEM | ASW | — | AWNR | ALL | ASTHNR | — |
| STW | X | CTWR | DER | ASH | ASH | AHNR | — | ASWHNR | — |
| STH | — | CTHN | DY | ASN | ANN | ASCTW | AGG | ACTWHN | ABY |
| STN | SV | CTHR | FR | ASR | ARR | ASCTH | AGH | ACTWHR | ABR |
| STR | STR | CTNR | DEL | ACT | AD | ASCTN | AGN | ACTWNR | ADDL |
| SWH | — | CWHN | PY | ACW | AP | ASCTR | AGR | ACTHNR | AFL |
| SWN | SM | CWHR | PHR | ACH | ACH | ASCWH | ASPH | ACWHNR | — |
| SWR | — | CWNR | PL | ACN | AZ | ASCWN | APP | ATWHNR | — |
| SHN | SY | CHNR | CRY | ACR | ACR | ASCWR | APPR | ASCTWHN | — |
| SHR | SHR | TWHN | KN | ATW | ATT | ASCHN | — | ASCTWHR | ABBR |
| SNR | SL | TWHR | KR | ATH | ATH | ASCHR | — | ASCTWNR | AGGL |
| CTW | DW | TWNR | JER | ATN | AV | ASCNR | — | ASCTHNR | AFFL |
| CTH | F | THNR | TRY | ATR | ATR | ASTWH | ASK | ASCWHNR | — |
| CTN | DEV | WHNR | — | AWH | AWH | ASTWN | — | ASTWHNR | — |
| CTR | DR | SCTWH | — | AWN | AM | ASTWR | — | ACTWHNR | ABL |
| CWH | PH | SCTWN | — | AWR | — | ASTHN | — | ASCTWHNR | — |
| CWN | PN | SCTWR | — | AHN | AY | ASTHR | — | | |
| CWR | PR | SCTHN | GY | AHR | — | | | | |
| CHN | CY | SCTHR | — | ANR | AL | | | | |

FIG. 4

INVENTOR.
DOTHAN L. SHELTON
BY C. W. Coffee
ATTORNEY

FINAL LETTERS

| KEYS | LETTERS | KEYS | LETTERS | KEYS | LETTERS | KEYS | LETTERS | KEYS | LETTERS |
|---|---|---|---|---|---|---|---|---|---|
| R | R | RHT | RTH | RLGH | — | RNLGC | LB | NCHTS | NDS |
| N | N | RHS | WS | RLGT | — | RNLGH | LM | LGCHT | — |
| L | L | RTS | RTS | RLGS | — | RNLGT | LK | LGCHS | — |
| G | G | NLG | D | RLCH | — | RNLGS | — | LGCTS | CKLES |
| C | C | NLC | SP | RLCT | — | RNLCH | LCH | LGHTS | — |
| H | H | NLH | SH | RLCS | RPS | RNLCT | LP | LCHTS | PTHS |
| T | T | NLT | ST | RLHT | — | RNLCS | PLES | GCHTS | — |
| S | S | NLS | SS | RLHS | WLS | RNLHT | — | RNLGCH | — |
| RN | RN | NGC | GG | RLTS | — | RNLHS | LVES | RNLGCT | — |
| RL | RL | NGH | M | RGCH | RF | RNLTS | RSTS | RNLGCS | LBS |
| RG | RG | NGT | NK | RGCT | — | RNGCH | — | RNLGHT | — |
| RC | RC | NGS | NGS | RGCS | RBS | RNGCT | — | RNLGHS | LMS |
| RH | W | NCH | NCH | RGHT | WK | RNGCS | — | RNLGTS | LKS |
| RT | RT | NCT | TION | RGHS | — | RNGHT | — | RNLCHT | — |
| RS | RS | NCS | NCES | RGTS | RKS | RNGHS | RMS | RNLCHS | LD |
| NL | S | NHT | NTH | RCHT | — | RNGTS | — | RNLCTS | LPS |
| NG | NG | NHS | VES | RCHS | RD | RNCHT | — | RNLHTS | — |
| NC | NC | NTS | NTS | RCTS | — | RNCHS | WD | RNGCHT | — |
| NH | V | LGC | BL | RHTS | RTHS | RNCTS | — | RNGCHS | — |
| NT | NT | LGH | X | NLGC | — | RNHTS | WTHS | RNGCTS | — |
| NS | NS | LGT | KL | NLGH | SM | RLGCH | — | RNGHTS | — |
| LG | LG | LGS | — | NLGT | SK | RLGCT | — | RNCHTS | WDS |
| LC | P | LCH | PH | NLGS | DS | RLGCS | — | RLGCHT | — |
| LH | Z | LCT | PT | NLCH | — | RLGHT | — | RLGCHS | — |
| LT | LT | LCS | PS | NLCT | NST | RLGHS | — | RLGCTS | — |
| LS | LS | LHT | LTH | NLCS | SPS | RLGTS | — | RLGHTS | — |
| GC | B | LHS | ZES | NLHT | — | RLCHT | — | RLCHTS | RLDS |
| GH | GH | LTS | LTS | NLHS | SHES | RLCHS | RLD | RGCHTS | — |
| GT | K | GCH | F | NLTS | STS | RLCTS | — | NLGCHT | MPT |
| GS | GS | GCT | CK | NGCH | MB | RLHTS | — | NLGCHS | MPS |
| CH | CH | GCS | BS | NGCT | BT | RGCHT | — | NLGCTS | — |
| CT | CT | GHT | GHT | NGCS | GGS | RGCHS | — | NLGHTS | DTHS |
| CS | CS | GHS | GHS | NGHT | NGTH | RGCTS | — | NLCHTS | — |
| HT | TH | GTS | KS | NGHS | MS | RGHTS | WKS | NGCHTS | — |
| HS | HS | CHT | TCH | NGTS | NKS | RCHTS | RDS | LGCHTS | — |
| TS | TS | CHS | D | NCHT | — | NLGCH | MP | RNLGCHT | — |
| RNL | LL | CTS | CTS | NCHS | ND | NLGCT | — | RNLGCHS | — |
| RNG | GN | HTS | THS | NCTS | — | NLGCS | — | RNLGCTS | — |
| RNC | — | RNLG | DL | NHTS | NTHS | NLGHT | DTH | RNLGHTS | — |
| RNH | WN | RNLC | PL | LGCH | LF | NLGHS | SMS | RNLCHTS | LDS |
| RNT | RNT | RNLH | LV | LGCT | CKL | NLGTS | SKS | RNGCHTS | — |
| RNS | RNS | RNLT | RST | LGCS | BLES | NLCHT | — | RLGCHTS | — |
| RLG | — | RNLS | LLS | LGHT | XT | NLCHS | — | NLGCHTS | MPTS |
| RLC | RP | RNGC | — | LGHS | XES | NLCTS | — | RNLGCHTS | — |
| RLH | WL | RNGH | RM | LGTS | — | NLHTS | — | E \| Y | E \| Y |
| RLT | — | RNGT | — | LCHT | PTH | NGCHT | — | CTE | CATE |
| RLS | RLS | RNGS | GNS | LCHS | PHS | NGCHS | MBS | LGY | LOGY |
| RGC | RB | RNCH | RV | LCTS | — | NGCTS | BTS | GTSE | KES |
| RGH | RGH | RNCT | — | LHTS | — | NGHTS | NGTHS | TSY | YS |
| RGT | RK | RNCS | — | GCHT | FT | | | | |
| RGS | RGS | RNHT | WTH | GCHS | DG | | | | |
| RCH | RCH | RNHS | WNS | GCTS | CKS | | | | |
| RCT | — | RNTS | — | GHTS | GHTS | | | | |
| RCS | RCS | RLGC | — | CHTS | DS | | | | |

FIG. 5

INVENTOR.
DOTHAN L. SHELTON
BY C. M. Coffee
ATTORNEY

SYLLABIC TYPEWRITER

BACKGROUND OF THE INVENTION:

1. Field of the Invention

This invention relates to improvements in the art of data processing as it pertains to recording, transmitting, displaying, and printing of indicia in the process of communication and exchange of information; and more particularly to keyboards for typewriters, writing machines, and related devices using keyboard input. (197/100).

2. Description of the Prior Art

Keyboards similar to the one comprising this invention are used on what is known to the art as shorthand typewriters, such as the machine known commercially as the "Stenotype." Devices in this category are designed to print an abbreviated phonetic code on paper tape, which can be read only by those knowing the code and system of writing. While the improved keyboard comprising this invention is based upon the syllabic structure of words, and in some particulars is similar to the "shorthand" keyboard, it is markedly different in that it is designed to write words according to their proper spelling, and is to be used with writing machines which produce a full page transcript in clear print and conventional spelling; not an abbreviated code in cryptographic form.

Keyboards for stenographic machines have been designed which in a large measure eliminate code writing, such as the keyboards disclosed in U.S. Pat. No. 1,294,611 issued to Bailey Tyler Bryan, and U.S. Pat. No. 2,246,195 issued to J. L. Sweeney. It should be observed, however, that these keyboards were designed for phonetic spelling, whereas my improved keyboard is designed for writing words according to their conventional spelling. The Bryan keyboard contains 35 letter keys and the Sweeney keyboard contains 48 letter keys as compared with only 25 letter keys on my improved keyboard, which makes it easier to learn and easier to operate. The Bryan and Sweeney keyboards were designed for use on machines which print the letters in fixed position on a paper tape in vertical progression; whereas, my improved keyboard is designed for use on page printing writing machines which print the letter in horizontal progression. The space keys provided on their keyboards serve to provide vertical line spacing of the printed record; whereas the space keys of my keyboard serve to provide horizontal spacing between words. Also, see Holmes U.S. Pat. No. 2,505,046.

The standard typewriter keyboard as it is known today is very little removed from the keyboard used on the first practical typewriter as designed by Sholes and Glidden, and which appeared on the market about 1867. The mechanics of the typewriter have been refined and power means for actuating the printing elements have been developed, giving the standard typewriter a potential speed in excess of 300 words per minute. The lack of scientific design in the standard keyboard is pointed out in U.S. Pat. No. 2,040,248 issued to August Dvorak and William L. Dealey. The improvement effected by the Dvorak-Dealey keyboard did not give sufficient increase in speed over the standard keyboard to justify commercial acceptance.

SUMMARY OF THE INVENTION

This keyboard not only enables the majority of the typing to be done with the index finger and long finger, but, also, when there is a combination of keys to be operated by a single finger, this is more frequent with the more agile fingers.

In order to simplify the presentation of this invention, the meaning of the word "write" as used herein is extended to include the process of encoding by mechanical, optical, thermal, electronic, or other means; on punched tape or cards, magnetic tape or cards, magnetic disks, and electronic memory devices of whatever kind; for storage, telegraphic transmission, electronic display, optical display, or hard copy printout of indicia used in the exchange and transmission of communicable information.

The expression "writing machine" when used herein is intended to include all variations of typewriters, line printers, shorthand machines, thermographic printers, optical printers, electrostatic printers, cathode ray tubes, other optical recording and display devices, punched tape machines, magnetic tape machines, magnetic disk machines, teletypewriters, facsimile printers, and any and all devices used in the recording, storing, transmission, displaying, and printing of alphabetic and numeric information.

More particularly, this invention relates to improvements in syllabic keyboards for writing machines wherein the finger keys for the various letters and symbols used in writing are divided into three primary groups consisting of vowel keys which are medially and forwardly situated on the keyboard, initial consonant keys situated on the left of the vowel keys, and final consonant keys situated on the right of the vowel keys. Control keys are located medially. Number keys are located above the initial and final keys.

The improvement consists in the arrangement and positioning of the letter keys in relation to each other and in relation to the control keys so that the operator with a single stroke on the keyboard can, with but a few exceptions, write all of the letters and functions comprising a single syllable word. Two and three syllable words usually require a stroke for each syllable. Simultaneously with stroking the letter keys, the operator can stroke the control keys to effect the printing of an initial capital and to povide spacing between words.

Typewriters, line printers, and optical display devices have been designed and are in common use which will write far in excess of the speed possible on the standard keyboard. Operators are unable to reach the potential speed of the standard typewriter and other writing machines for the very elementary reason that they cannot stroke the keys as fast as the machines can write. Each stroke on the improved keyboard comprising my invention will produce an average of a little more than four type actions, thus reducing the finger actions greatly.

2. Objects of this Invention

One of the primary objects of this invention is to provide a keyboard for writing machines on which an operator can write at the speed of spoken language and at the same time produce a full page transcript of the material written with conventional spelling and typography.

Another object of this invention is to provide a keyboard for writing machines with the keys so arranged that most single syllables and one-syllable words can be written with a single stroke of the keyboard.

Another object of this invention is to provide a keyboard having capital shift keys so positioned that an operator can conventiently stroke them simultaneously with the letter keys for writing an initial capital letter.

A further object of this invention is to provide a keyboard for writing machines on which most of the control keys are centrally located for easy operation by the two index fingers.

Another object of this invention is to provide a keyboard for writing machines having two space keys so positioned in relation to the initial and final letter keys that they can be selectively stroked singly or in combination with the letter keys to provide spaces between words.

Another object of this invention is to provide a keyboard for writing machines on which the back space key is positioned in close proximity to the space key so that it can be stroked separately or in combination with the space key.

Another object of this invention is to provide a keyboard with a clear key positioned for easy operation by either index finger for clearing the keyboard of erroneous or unwanted selections.

Another object of this invention is to provide a keyboard having punctuation mark keys positioned for simultaneous operation with the letter keys.

A further object of this invention is to provide a keyboard for writing machines on which the above objects may be accomplished with a minimum number of keys.

A further object of this invention is to provide a keyboard for writing machines having a minimum number of keys so arranged and positioned that an operator can reproduce a maximum number of words in full and clear print with a minimum amount of effort.

Further objects are to achieve the above with a device that is sturdy, compact, durable, lightweight, simple, efficient, versatile, and reliable, yet inexpensive, and easy to manufacture, operate, and maintain.

The specific nature of the invention, as well as other objects, uses, and advantages thereof, will clearly appear from the following description and from the accompanying drawing, the different views of which are not necessarily to the same scale.

BRIEF DESCRIPTION OF THE DRAWING

FIG. 4 is a columnar tabulation of initial letter key combinations, showing all possible key combinations and the letters encoded or written by each combination.

FIG. 5 is a columnar tabulation of final letter key combinations, showing all possible key combinations and the letters encoded or written by each combination.

DESCRIPTION OF THE PREFERRED EMBODIMENT

Figure 1:
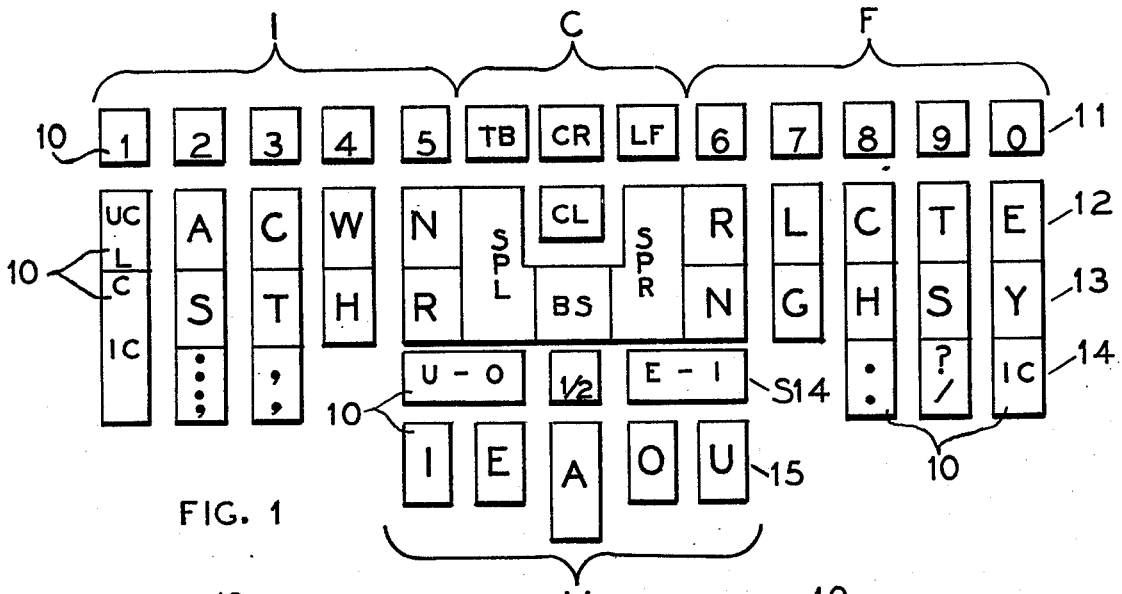
FIG. 1 is a plan view of my improved keyboard for writing machines showing the arrangement of the finger keys.
Figure 3:
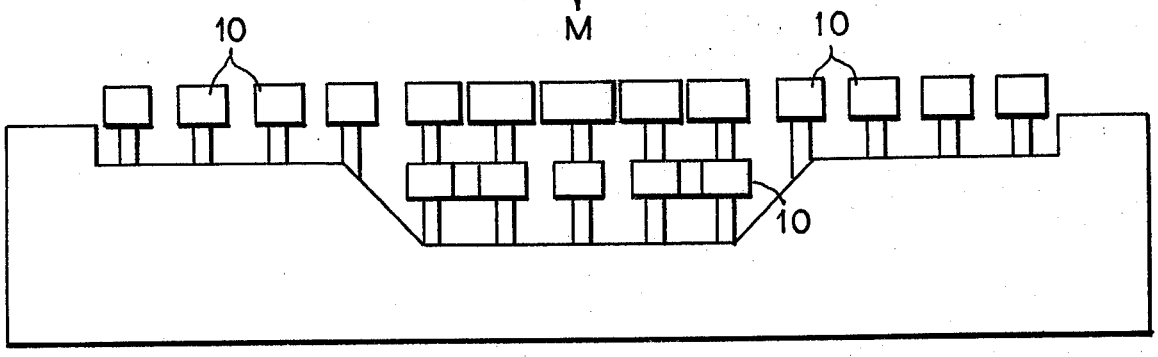
FIG. 3 is a front elevation of my improved keyboard showing the lower elevation of the medial section of keys in relation to the remainder of the keyboard.

In order to avoid confusion in making reference to the drawings, all references to the keys will be made by use of the legends appearing thereon in the drawings, with the introduction of as few reference numerals as practicable. Such reference numerals as are used will begin with the number 10.

The keyboard disclosed in FIG. 1 is made up of fifty finger keys 10 arranged in five transverse rows and thirteen longitudinal rows. The longitudinal rows will hereinafter be referred to as "columns" and the transverse rows will be referred to simply as "rows." Each column will be designated by the key legend appearing on the key at the top of the column, which keys comprise the back transverse row. The transverse rows are designated as the back row 11, the second row 12, the third row 13, the fourth row 14, the front row 15, and the sub-row S14.

Figure 2:
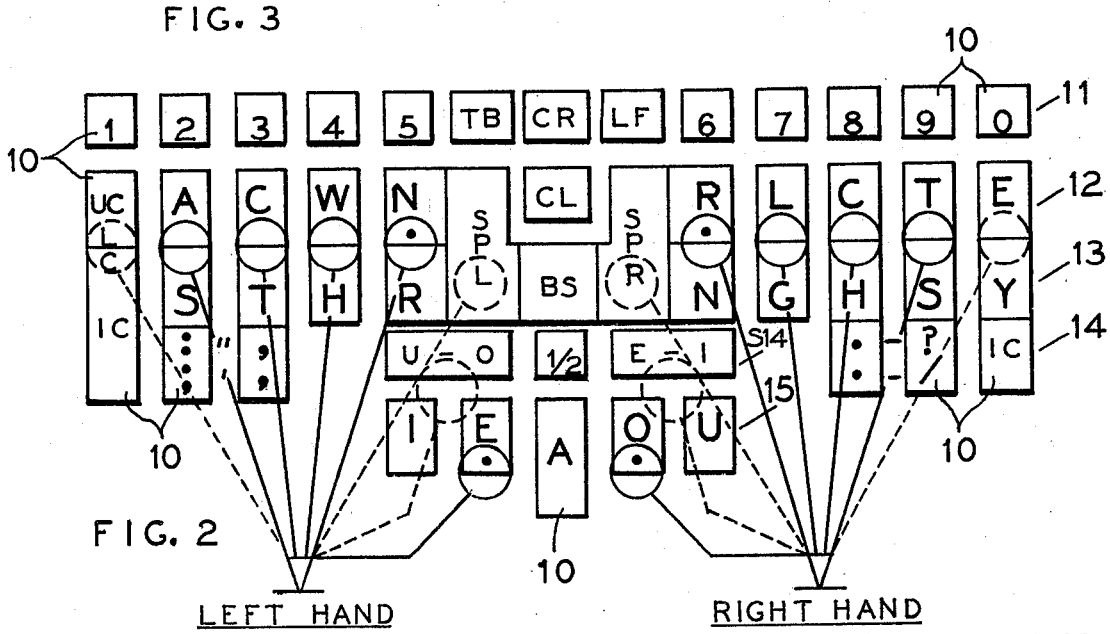
FIG. 2 is a plan view of my improved keyboard showing the arrangement of keys with "stick" hands superimposed thereon to indicate the relationship of the fingers to the various keys with alternate positions of the fingers shown in dotted lines.

The columns of keys are divided into four sections comprising a centrally positioned control section C, an initial section I positioned to the left of the C section, a final section F positioned to the right of the C section, and a medial section M positioned on a lower plane forward of the C section and intermediate the I and F sections. As indicated in FIG. 2, the I section of the keyboard is operated by fingers of the left hand, the F section is operated by the fingers of the right hand, and the M section is operated by the thumbs. The C section is operated by the two index fingers as shown in dotted lines in FIG. 2.

The position of the hands in relation to the keyboard is indicated in FIG. 2 by stick hands superimposed on the keyboard. The fingers are shown as resting in home position, which is located on the keyboard by placing the index fingers on the nibs 16 provided on the keys N and R. The left thumb is placed on the nib 16 on the medial key E and the right thumb on the nib of key O. The other fingers should rest lightly on the division between the second and third rows of keys. With the fingers in home position, a minimum of movement is required to finger the keys in the various combinations which make up words and syllables.

The initial section I of the keyboard is comprised of seventeen finger keys 10 which are divided into five columns extending across four rows. The back row 11 contains keys for writing the numerals 1, 2, 3, 4, and 5 in lower case mode, and the characters, ±, @, #, $, and % in upper case mode. The numerals comprising the back row are used as reference numerals to designate the column of keys with which they are associated.

Column 1 keys consist of the numeral key 1, the shift key UC for upper case shift, and the shift key IC for initial capital shift. When the keys UC and IC are stroked together, they will cause the machine to shift to lower case mode. Column 1 keys are operated by the left little finger and may be operated at the same time with any other keys on the keyboard.

Column 2 spands four rows of keys and includes the numeral key 2, the letter keys A and S and the punctuation key for the semicolon (;) in lower case mode and the colon (:) in upper case mode. Column 2 keys are operated by the left little finger.

Column 3 spans four rows and includes the numeral key 3, the letter keys C and T, and the punctuation key for the comma (,). Column 3 keys are operated by the third finger of the left hand.

Column 4 spans three rows and includes the numeral key 4, and the letter keys W and H. These keys are stroked with the second finger of the left hand.

Column 5 spans three rows and includes the numeral key 5 and the letter keys N and R. These keys are operated by the left index finger.

The final section F of the keyboard is comprised of eighteen finger keys 10 which are divided into five columns which span four rows. The back row contains the numeral keys 6, 7, 8, 9, and 0 in lower case mode and the characters ¢ , &, *, (, and ) in upper case mode. The numerals are used as in section I to designate the column of keys with which they are associated.

Column 6 spans three rows and includes the numeral key 6, and the letter keys R and N. These keys are operated by the right index finger.

Column 7 spans three rows and consists of the numeral key 7 and the letter keys L and G. Column 7 keys are stroked with the second finger of the right hand.

Column 8 spans four rows and includes the numeral key 8, the letter keys C and H, and the punctuation key for the period (.). Column 8 keys are operated by the third finger of the right hand.

Column 9 spans four rows and includes the numeral key 9, the letter keys T and S, and the punctuation key for the slash (/) in lower case mode and the question mark (?) in upper case mode. Column 9 keys are operated by the right little finger.

Column 0 (zero) spans four rows and includes the numeral key 0, the letter keys E and Y, and the right hand IC key for initial capital shift. The column 0 keys are stroked with the right little finger.

The medial section M is situated in a horizontal plane approximately three-fourths of an inch lower than the other sections and consists of eight keys arranged in two transverse rows. The front row 15 consists of five keys for the letters I, E, A, O, and U. The the next row S14 back of the front row 15 consists of three keys for the letters U-O, 1/2, and E-I. The keys U-O and E-I are double length keys and are mounted back of the keys I and E, and O and U respectively. The medial section keys are operated by the thumbs. The left thumb operates the A key and the ½ key, and the vowel keys to the left, I, E, and U-O. The right thumb operates the A key and the vowel keys to the right, O, U, and E-I.

Centrally located on the keyboard in the upper horizontal plane is the control section C consisting of seven keys arranged in three columns spanning three rows. The back row of the C section consists of the keys TB, CR, and LF, for tabulate, carriage return, and line feed respectively. The central column of keys in this section is also the central column of the keyboard and includes the carriage return key CR in the back row 11, the clear key CL in the second row 12, and the back space key BS in the third row 13. These keys may be operated by either index finger.

To the immediate left of the central column and forward of the TB key is the left hand space key SPL. To the immediate right of the central column and forward of the LF key is the right space key SPR. The space keys are double length keys and span the second and third row of keys, and are spaced in close relation to the back space key BS so that the BS key can be operated either separately or simultaneously with either space key, with either index finger. The keys SPL and BS are operated separately or in combination by the left index finger. The keys SPR and BS are operated separately or in combination by the right index finger. The space keys SPL and SPR are placed in close proximity to the initial letters keys NR and the final letter-keys RN, respectively, so that the left index finger can operate the keys SPL, N, and R either separately or simultaneously; and the right index finger can operate the keys SPR, R, and N either separately or simultaneously. The operation of the space keys simultaneously with the adjoining letter keys makes it possible to follow each word with a space without making an extra stroke.

The initial letter section of keys I is used to write the initial consonants and consonant combinations that appear at the beginning of words and syllables and the initial vowel A. The final letter section of keys F is used to write consonants and consonant combinations that appear at the end of words and syllables, and the final vowels E and Y. The medial section of keys M is used to write the vowels and vowel combinations. With this arrangement of keys, most one syllable words can be written with a single stroke on the keyboard. Words of more than one syllable usually require a stroke on the keybord for each syllable. In actual practice approximately 75% of all written and spoken English consists of one syllable words.

The finger keys when stroked separately will write the letter displayed on the key. These are called "key letters." When stroked in predetermined combinations, the keys will write other letters not displayed on the keyboard. These are called "code letters." With the arrangement of keys and the choice of the "key letter" assigned to each key as shown in the drawings, at least 80% of all letters written are "key letters," and only 20% are "code letters." This arrangement of letters makes for simplicity and efficiency in writing.

The finger keys required to write each letter of the English alphabet are shown in the following tabulation:

INITIAL LETTERS

| LETTERS | KEYS |
|---|---|
| A | A |
| B | CTWH |
| C | C |
| D | CT |
| F | CTH |
| G | SCT |
| H | H |
| J | TWN |
| K | TWH |
| L | NR |
| M | WN |
| N | N |
| P | CW |
| Q | TWN |
| R | R |
| S | S |
| T | T |
| V | TN |
| W | W |
| X | STW |
| Y | HN |
| Z | CN |

MEDIAL LETTERS

| LETTERS | KEYS |
|---|---|
| I | I |
| E | E |
| U | I U-O |
| O | E U-O |
| A | A |
| O | O |
| U | U |
| E | O E-I |
| I | U E-I |

FINAL LETTERS

| LETTERS | KEYS |
|---|---|
| B | GC |
| C | C |
| D | CHS |
| D | NLG |
| F | GCH |
| G | G |
| H | H |
| K | GT |
| L | L |
| LL | RNL |
| M | NGH |
| N | N |
| P | LC |
| R | R |
| S | S |
| S | NL |
| T | T |
| V | NH |
| W | RH |
| X | LGH |
| Y | Y |
| Z | LH |
| E | E |

It should be observed that in writing the various letter combinations and forming them into words, it is essential that the letters be written out in the proper order or sequence, as for example PL in please and LP in help. For machines using type bars, the letters may be arranged on the type heads in the sequence in which they appear in words and syllables. For machines using permutation means such as notched bars or permutation magnets, both of which are known in the art as disclosed in U.S. Pat. No. 2,346,819 issued to A. H. Buckley, and U.S. Pat. No. 2,684,745 issued to E. O. Blodgett, a sequence register of either mechanical or electronic design may be provided. My previous U.S. Pat. Nos. 1,932,914 and 3,026,984 both disclose mechanisms by which letter selections can be made on my improved keyboard and serially printed by the machine. In either mechanical or electronic design, the letters are arranged to print out in the following sequence:

INITIAL LETTERS

A J S S G Z C F T D E R V W P X K M N B Q L H R Y

MEDIAL LETTERS

I U E O A O E U I

FINAL LETTERS

R W N S L M D O G P T C B F H K X A T I L Z V S O N E Y S

NUMERALS

UC ± @ # $ % ¢ & * ( ) ¼

LC 1 2 3 4 5 6 7 8 9 0 ½

PUNCTUATION

UC " : , . ? --

LC ' ; , . / -

With further reference to the drawings, it should be observed that the initial and final letter keys are arranged in two transverse rows 12 and 13 which are spaced closely together so that the fingers of the left hand when in home position touch all of the initial letter keys and the fingers of the right hand touch all of the final letter keys except the final vowels E and Y. With the movement of the fingers a distance of only ⅜ths of an inch backward, the keys in row 12 can be fingered, or the movement of the fingers ⅜ths of an inch forward, brings them into position to finger the keys in row 13. It is apparent that with this spacial arrangement of keys and the selection of "key letters" and "code letters" as disclosed herein, within a span of ¾ths of an inch bridging the four initial consonant columns and the four final consonant columns, any consonant or combination of consonants appearing in the English language can be written with a single stroke with very few exceptions.

The vowel or medial letter keys are stroked with the thumbs. Either thumb may be used to stroke the medial A key. The left thumb is used to stroke the three vowel keys to the left of the A key, and the right thumb is used to stroke the three vowel keys to the right of the A key. These keys are easily under the control of the thumbs so that with slight movement, any combination of vowels may be written.

The facility with which both initial and final letters and letter combinations can be written on this keyboard may be seen by reference to FIGS. 4 and 5.

Referring to FIG. 4, it will be observed that with the eight initial letter keys it is possible to obtain 255 key combinations. Of this number 127 combinations are obtained from the seven consonant keys S C T W H N R, and 128 additional key combinations are obtained by including the initial vowel A. Of the 127 consonant key combinations 97 are used to write consonant letters and letter combinations used at the beginning of words. Of the 128 key combinations using the initial vowel key A, 85 are used to write letter combinations which include the initial vowel A. This gives a total of 255 possible key combinations using the initial letter keys A S C T W H N R, of which 182 are used to write letter combinations, leaving 73 open key combinations which may be used for additional initial letters and prefixes.

Referring to FIG. 5, with the eight final consonant keys R N L G C H T S it is possible to obtain 255 key combinations. Of this number, 168 key combinations are used to write letters and letter combinations, leaving 87 open combinations that may be used for additional final letters and suffixes. Two final vowel keys E and Y are provided and used for word endings in E and Y along with suffixes of which four are shown using these letters.

Some of the novel features of my keyboard consist of the arrangement of the control keys, so that control functions such as case shift, spacing, and back spacing may be set up on the keyboard simultaneously with word selections. Also, punctuation keys may be fingered simultaneously with word selections. Another novel feature is the arrangement of letters on the keys (key letters) so that more than 80% of the letters used are key letters and less than 20% are code letters requiring the use of two or more keys to write. The arrangement of code letters is also important even though they constitute less than 20% of the letters used. For instance, by referring to FIG. 4, it will be observed that the keys C and T when stroked together give the letter D. Inasmuch as D as an initial consonant is followed by R and W it must precede these letters on the keyboard so that CTR will write DR and CTW will write DW. It will also be observed that the keys CTH write F and the keys NR write L. If it is desired to write the letters FL, the keys CTHNR are stroked simultaneously, and if it is desired to write the letters FR, the keys CTHR are stroked simultaneously. From these illustrations, it will be observed that the letters, whether key letters or code letters, with few exceptions, write out in sequence from left to right on the keyboard. This is true also of the final section of the keyboard. For instance, if it is desired to write the word FLIGHT, the initial keys CTHNR, the vowel key I, and the final keys GHT are stroked simultaneously, and the machine writes out the word FLIGHT, with the final letters writing out in the same sequence as they appear on the keyboard. Exceptions to this rule are the initial keys HR which write out RH, and the final keys HT which write out TH.

In operation of this keyboard, letters are stroked simultaneously as whole words; and in the same way that letter sequences are stroked by reflex action on the standard keyboard, word sequences are stroked on this keyboard to form patterns which comprise commonly used phrases. Word counts have been made which indicate that, with the exception of highly technical writings, monosyllables comprise approximately 80% of all spoken and written English. For instance, there are two one-letter words, I and a, and 25 commonly used two-letters words such as is, to, and it, which comprise about 25% of all spoken and written English.

The facility with which the English language may be written on my improved keyboard is indicated by the following quotation from the patent issued to Dvorak and Dealy as previously cited:

"A study of language patterns reveals a very striking fact. Spoken or written language is based on a framework built up of a relatively small number of words, arranged in many patterns. For example, less than 3% in some 80,000 words used in 500 telephone conversations are different words. Little auxilliary verbs, such as is; pronouns, such as you; prepositions, such as on or to; conjunctions, such as any; articles, like the are only 5% of the different words used. Mostly these are monosyllables, yet they make up 57% of all these 500 telephone conversations, as counted by French. Their frame work supports the longer, more varied, less frequent words, which convey most of the meaning. — According to a scientific word count, for example 69 words represent one-half of written English; 640 words represent four-fifths of written English. Typing patterns are based upon this framework of a relatively small number of words which support the longer, more varied, less frequent words. Into this framework, the typist's motions are to be fitted with the aid of improved keyboard relations."

The keyboard comprising my invention is based on the structure of words and syllables as they appear in the English language. Every syllable other than single vowels, consists of one or the following combinations: (1) consonant and vowel; (2) vowel and consonant; (3) consonant, vowel and consonant. The terms "consonant" and "vowel" as used herein include both single letters and combinations of letters as the combinations TH--OU--GHT, making up the word "thought." The concept of writing as it relates to this invention regards the stroking unit not as an isolated key-stroke for each letter, but as a composite selection of keys comprising a whole word or syllable, with a series of commonly used monosyllables blending into a phrase.

It is to be understood that changes may be made with respect to the choice of keys for writing certain letter combinations without departing from the spirit of this invention. For instance, certain infrequent combinations occur on the keyboard as a consequence of the selection of other key combinations for more frequently occurring letter combinations. In some instances the burden of learning and remembering these combinations outweighs the advantage gained by their use. It is to be understood that changes to eliminate such infrequent combinations and to add other combinations are within the scope of this invention.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A syllabic keyboard for writing machines wherein the initial keys A C W N S T H R and the final keys R L C T E N G H S Y are arranged as follows: the initial keys are in a position to be operated with the fingers of the left hand; the A key is immediately back of the S key and the two keys are adjacent; there is a space between the A key and the C key; there is a space between the S key and the T key; there is a space between the C key and the W key; there is a space between the T key and the H key; the H key is immediately forward of the W key and there is a space between the H key and the R key; there is a space between the W key and the N key; the R key is immediately forward of the N key; and the final keys are in the position to be operated with the right hand, the R key is immediately behind the N key and adjacent thereto; there is a space between the R key and the L key; there is a space between the N key and the G key; the G key is immediately forward and adjacent to the L key; there is a space between the L key and the C key; there is a space between the G key and the H key; and the C key is immediately behind and adjacent to the H key; there is a space between the C key and the T key; there is a space between the H key and the S key, and the S key is immediately forward of the T key adjacent thereto; there is a space between the T key and the E key; and there is a space between the S key and the Y key, and the Y key is immediately forward of the E key and adjacent thereto.

2. The invention as defined in claim 1 with the additional limitation that there is a left hand space key adjacent to one side of the initial N key and the R key, and there is a back space key adjacent to the space key, there is a right hand space key adjacent to the back space key and also adjacent to the final R key and N key.

3. The invention as defined in claim 2 wherein the initial control keys and the final keys are on the same level.

4. The invention as defined in claim 3 with the additional limitation of vowel keys located at a level below the initial keys and the final keys.

5. The invention as defined in claim 3 with the additional limitation of vowel keys located lower and forward of the other keys and they are arranged in the following order: I E A O U with all vowel keys spaced one from the other and the A key longer than the other keys, and the I E and A keys positioned to be operated with the left thumb, and the U O and A key positioned to be operated with the right thumb.

6. The invention as defined in claim 5 with the additional limitation of an upper case lock key to the left of the initial A key and initial upper case key to the left of the S key, said upper lock key and initial upper case key adjacent one to the other with the initial key forward.

7. The invention as defined in claim 6 with the additional limitation of numerical keys behind each of the letter keys above defined, said numeral keys being in numerical order.

8. The invention as defined in claim 7 with the additional limitation of a tabulater key behind the left hand space key and a line feed key behind the right hand space key and a carriage return key between the tabulator key and the line feed key and a clear key immediately forward of the carriage return key, which clear key is between the left and right space keys.

9. A syllabic keyboard for writing machines with initial letter keys and final letter keys, a back space key centrally positioned between the initial and final letter keys, a left hand space key positioned between the back space key and the initial letter keys, and a right hand space key positioned between the back space key and the final letter keys, the keys being disposed for selective discrete or simultaneous operation.

10. The invention as defined in claim 9 with medial letter keys positioned on a lower plane forward of the space keys and disposed for operation by the thumbs.

11. The invention as defined in claim 10 with punctuation keys on the same plane with the initial and final letter keys and positioned forward of said keys and on each side of the medial letter keys, said punctuation keys disposed for selective discrete or simultaneous operation with the letter keys.

12. The invention as defined in claim 9 with a clear key positioned back of the back space key and disposed for operation with the index fingers.

13. The invention as defined in claim 12 with a carrier return key positioned back of the clear key and disposed for operation with the index fingers.

14. The invention as defined in claim 9 with a tabulator key positioned back of the left hand space key, and a line feed key positioned back of the right hand space key, said keys disposed for operation with the index fingers.

15. A syllabic keyboard for writing machines having a. initial letter keys positioned to the left of center and b. final letter keys positioned to the right of center, c. the keys being arranged in two groups including the letter keys

| | |
|---|---|
| ACWN | RLCTE |
| STHR | NGHSY |

d. said keys disposed for selective operation.

e. control keys positioned between the initial letter keys and the final letter keys, including f. a left hand space key positioned in spaced relation to the right of the initial letter keys, and g. a right hand space key positioned in spaced relation to the left of the final letter keys, and h. a back space key positioned in spaced relation between the left hand space key and the right hand space key, i. said control keys disposed for selective operation with the index fingers.

16. A syllabic keyboard for writing machines having a. initial letter keys positioned to the left of center, b. final letter keys positioned to the right of center, and c. medial letter keys positioned forward of center, d. the keys being arranged in three groups comprising the keys

| | |
|---|---|
| ACWN | RLCTE |
| STHR | NGHSY |
| UO | EI |
| IEAOU | |

e. said keys disposed for selective discrete or simultaneous operation, f. control keys positioned between the initial and final letter keys and back of the medial letter keys, g. said control keys arranged in three columns, the keys TB and SPL comprising the left hand column, keys LF and SPR comprising the right hand column, and the keys CR, CL, and BS comprising the middle column, h. said control keys disposed for selective operation with the index fingers.

* * * * *